United States Patent [19]

Hills et al.

[11] Patent Number: 4,655,884

[45] Date of Patent: Apr. 7, 1987

[54] NICKEL PLATING OF REFRACTORY METALS

[75] Inventors: Stanley Hills, Cherry Hill, N.J.; James K. Landon, Pottstown, Pa.

[73] Assignee: General Electric Company, Philadelphia, Pa.

[21] Appl. No.: 767,384

[22] Filed: Aug. 19, 1985

[51] Int. Cl.[4] ..... C25D 5/38

[52] U.S. Cl. ..... 204/321; 204/29; 204/37.1; 204/40

[58] Field of Search ..... 204/29, 32.1, 37.1, 204/40

[56] References Cited

U.S. PATENT DOCUMENTS

| | | | |
|---|---|---|---|
| 2,492,204 | 12/1949 | Van Gilder . | |
| 2,546,150 | 3/1951 | Brenner et al. . | |
| 2,859,158 | 11/1958 | Schaer | 204/37 |
| 3,002,899 | 10/1961 | Reid, Jr. . | |
| 3,314,867 | 4/1967 | Gore | 204/32 |
| 3,672,964 | 6/1972 | Bellis . | |
| 4,092,448 | 5/1978 | Coll-Palagos . | |
| 4,139,933 | 2/1979 | Ballard et al. . | |
| 4,236,940 | 12/1980 | Manty et al. . | |
| 4,461,679 | 7/1984 | Higuchi et al. . | |

OTHER PUBLICATIONS

F. A. Lowenheim, *Electroplating,* McGraw-Hill Book Co., New York, 1978, pp. 216–224.

Yaniv et al., *Electrodeposition of Nickel on Tantalum,* Transations of the Institute of Metal Finishing, vol. 48, 1970, pp. 5–10.

Seegmiller et al., *Adherent Electroplated Coatings on Tungsten, Molybdenum, Tantalum and Niobium,* Technical Proceedings of the American Electroplaters Society, vol. 49, 1962, pp. 67–70.

Saubestre, E. B., *Electroplating on Certain Transition Metals,* Journal of the Electrochemical Society, vol. 106, No. 4, Apr., 1959, pp. 305–309.

*Primary Examiner*—John F. Niebling

*Assistant Examiner*—William T. Leader

*Attorney, Agent, or Firm*—Allen E. Amgott

[57] ABSTRACT

An improved method of depositing nickel on a clean refractory metal surface to form a multilayer article is disclosed, wherein the full thickness of nickel can be plated prior to the intermetallic bonding of the metals. The metal surface is cleaned and etched prior to the application of a first layer of nickel on the surface by electroplating means. After the article is rinsed, a second layer of nickel is applied to the first layer of nickel by electroplating means. The article is then heated in the absence of air to cause intermetallic bonding between nickel and the refractory metal substrate.

31 Claims, No Drawings

NICKEL PLATING OF REFRACTORY METALS

The Government has rights in this invention pursuant to Contract No. F04704-82-C-0018 awarded by the Department of the Air Force.

BACKGROUND OF THE INVENTION

This invention relates to a process for applying nickel on a refractory metal surface. More particularly, it relates to an improved and simplified electroplating process used to obtain an adherent nickel layer on a refractory metal surface.

Refractory metals are used for many purposes, such as rocket nozzles and other "hot structures" capable of supporting aerodynamic and thermal stresses, as well as for insulation-backed heat shields protecting low-temperature structural members. However, because the surfaces of these refractory metals are susceptible to corrosion and frictional wear, it is often necessary or recommended to plate them with other metals, such as chromium, copper and nickel. Unfortunately, refractory metals such as titanium and tantalum are often difficult to plate satisfactorily with an adherent metal coating. For instance, when attempts have been made to apply a metal coating, such as nickel or chromium, on tantalum, the tantalum spontaneously undergoes oxidation to form an oxide film on its surface, and the oxide surface interferes with the chemical bonding of a subsequently deposited nickel layer.

Refractory metals are more readily coated with nickel by electroplating means, as opposed to electroless plating means. However, the electroplating methods often involve a two-step deposition procedure in which a heat treatment to induce diffusion bonding is required between the steps. For instance, in *Electrodeposition of Nickel or Tantalum* by A. Yaniv (Transactions of the Institute of Metal Finishing, 1970, Vol. 48, pp 5–10), an adherent nickel deposit is applied on tantalum by plating in two stages, with a heat treatment between the stages. The intervening heat treatment generally requires preliminary rinsing and drying steps, and the heat-treated deposit must be reactivated prior to resumption of plating. This complicates the entire plating process, thereby resulting in increased processing and handling time requirements which, in turn, result in high production costs.

It is an object of this invention to provide an improved process for plating nickel on a refractory metal surface which is not subject to the above-mentioned problems and disadvantages.

It is another object of this invention to provide an improved process for plating nickel on a refractory metal surface.

It is a further object of this invention to simplify the process for electroplating nickel on a refractory metal surface while insuring the adherence of nickel to the surface.

Other objects and advantages of the invention will become apparent as the description thereof proceeds.

SUMMARY OF THE INVENTION

The foregoing objects are achieved by an improved method of depositing nickel on a clean refractory metal surface of an article to form a multi-layer article, comprising etching the surface and then rinsing the etched surface, followed by applying a first layer of nickel on the surface of the article by electroplating means and, thereafter, again rinsing the surface. A second layer of nickel, i.e., a thickening of the first layer, is then applied on the first layer of nickel by electroplating means. The article is then heated in the absence of air for a period of time sufficient to intermetallically bond the nickel to the refractory metal.

By the process of the present invention, it has been found that excellent adherence of the nickel to the refractory metal substrate is achieved. Furthermore, the present invention allows the full thickness of nickel to be plated prior to the heating step used to cause intermetallic bonding between nickel and the refractory metal, thereby simplifying the plating process and greatly reducing processing costs.

DETAILED DESCRIPTION OF THE INVENTION

The process of the present invention may be used to deposit nickel on a variety of refractory metals, such as titanium, zirconium, hafnium, vanadium, niobium, tantalum, chromium, molybdenum, tungsten or mixtures thereof. The preferred refractory metal for the present process is tantalum (Ta). The refractory metal articles to be plated may be any of a number of sizes and shapes, depending upon the end use contemplated for the articles.

Only refractory metal surfaces which are clean can be used in the process of the present invention, and generally, surface preparation of the refractory metal article is first undertaken to insure a very clean surface for the subsequently deposited nickel layers. Organic soils are removed from the surface by typical solvent cleaning techniques, such as vapor degreasing and ultrasonically assisted solvent immersion. Typical cleaning methods are described in the Kirk-Othmer Encyclopedia of Chemical Technology, Third Edition, Vol. 8, John Wiley & Sons, 1979, pp. 828–830.

An optional second step involves abrading the surface to allow satisfactory mechanical bonding of the nickel to the surface. Many well-known abrasion techniques may be used, such as an alumina pressure blast or a glass bead blast. Typically, the abrasive material is suspended in a high velocity gas stream adjacent the surface such that energetic impingement of the small abrasive particles causes pitting of the substrate surface. The objects of the present invention may be achieved without the abrasion step, although it is preferable to include the step.

The abraded surface is then chemically cleaned by etching with an acidic cleaning solution. An example of a typical cleaning solution is about 50% by volume hydrofluoric acid and about 50% by volume water. However, the volume of hydrofluoric acid may range from about 30% to about 60%. It is also preferable to include a small amount of nitric acid in the hydrofluoric acid/water mixture, for example, about 50% by volume hydrofluoric acid, about 45% by volume water, and about 5% by volume nitric acid. Ultrasonic agitation of the article in the solution helps to increase the efficiency of the etching treatment in removing oxides and residual abrasive, if present. The article is then rinsed with a suitable rinsing agent, for example, water, to remove any residual etching solution.

A first layer of nickel is then applied to the clean, etched surface of the refractory metal by electroplating means. This first layer of nickel is typically very thin and may be referred to as a strike plate. In preferred embodiments, the first layer of nickel is about 0.1 mil to about 0.2 mil in thickness. Several types of electroplating baths, such as a Woods nickel electroplating bath or a Watts bath, may be used to apply the first layer of nickel. Some typical types of nickel electroplating baths suitable for depositing the first layer of nickel in accordance with the process of the present invention are described in the Kirk-Othmer Encyclopedia of Chemical Technology, Third Edition, Vol. 8, John Wiley & Sons, 1974, pp. 848–852. A plating bath comprising nickel sulfate, nickel chloride and boric acid, such as a Watts bath, is preferred for this step, and is well-known to those skilled in the art. A voltage of about 3 volts to about 5 volts is applied to the article, preferably prior to immersion of the article in the bath. Upon immersion of the article, the electrical circuit is completed, and a suitable electric current, for example, an electric current resulting in a current density of about 25 amperes per square foot to about 45 amperes per square foot, is imparted to the article. Alternatively, the voltage may be applied to the article after immersion in the bath. The temperature of the bath may be about 45° C. to about 65° C. The period of time sufficient to completely cover the surface of the refractory metal with the desired thickness of nickel sufficient to form the first layer is generally from about 3 minutes to about 7 minutes. The longer periods of time compensate for the decrease in bath efficiency occurring when lower electrical currents are utilized. Likewise, shorter time periods may be used when higher electrical currents are applied. The thickness of the first layer is controlled by the magnitude of the current and the length of time current is imparted to the article. The adherence of the first layer of nickel, i.e. the strike plate, is primarily due to mechanical bonding in which the nickel applied on the refractory metal surface fills pits and other irregularities in the refractory metal surface, thereby anchoring the nickel layer to the surface. A stronger mechanical bond between the nickel and the surface of the refractory metal is formed when the surface is abraded prior to being chemically cleaned by etching in an acidic cleaning solution, as described above.

After the first layer of nickel has been applied to yield a continuous nickel surface completely covering the refractory metal substrate, the surface is rinsed with water to remove any residual plating bath material. A second layer of nickel is then applied on the first layer of nickel, and the first and second layers become homogeneous, e.g., the second layer is merely a thickening of the first layer. A wide variety of electroplating baths may be utilized for this step, e.g. sulfamate (also referred to as sulfamate nickel), fluoborate, chloride, chloride sulfate, nickel-cobalt, and the like. The preferred electroplating bath is a sulfamate bath, well-known to those skilled in the electroplating art and comprising, for example, about 450 grams per liter of nickel sulfamate and about 30 grams per liter of boric acid. Various other well-known additives may be added to the bath for use as antipitting agents, brighteners, levelers, stress reducers, and the like. As with the first layer of nickel, a voltage of about 3 volts to about 5 volts is applied to the article, preferably prior to immersion of the article in the bath. Upon immersion of the article, the electrical circuit is completed, and a current is imparted to the article. The article remains immersed for a time period sufficient to deposit nickel to a desired thickness. Alternatively, the voltage may be applied to the article after immersion in the bath. A suitable electric current, for example, an electric current resulting in a current density of about 20 amperes per square foot to about 60 amperes per square foot, may be imparted to the article in the bath. The time period of immersion may generally range from about 4 hours to about 14 hours, with the longer time periods compensating for lower magnitudes of electric current. The article may be rotated in the bath to insure a uniform deposition of nickel on the entire surface of the article. The bath may also be stirred or agitated during the plating step to stimulate the movement of the nickel ions so as to replenish the supply of nickel ions near the surface of the article being plated. The temperature of the bath may be about 40° C. to about 60° C. An increase in bath temperature (within the above-mentioned range) also serves to stimulate the movement of nickel ions. It will be apparent to those skilled in the electroplating arts that all of the bath parameters may be easily adjusted if a bath different from the sulfamate-type is used. The thickness of the second layer of nickel is not critical and is dependent both upon the end use of the article and whether a third layer of material will be applied on top of the second layer of nickel, as described below.

After the second layer of nickel has been applied on the first layer of nickel, the article may be rinsed with a suitable liquid such as water to remove any residual electroplating bath. The article is then completely dried by any conventional method. It is preferred that the article be completely dry prior to the heat treatment step described below, although the heat treatment itself is generally effective in drying the article.

The article is then heated in the absence of air for a period of time sufficient to cause intermetallic bonding between nickel and the refractory metal. Any protective atmosphere furnace capable of sustained temperatures up to about 700° C. is suitable for this heating step. The article may be heated in a vacuum or in an inert atmosphere, such as argon or helium. Generally, heating the article at temperatures of about 500° C. to about 650° C. for about 60 minutes to about 120 minutes improves adherence of the nickel to the surface of the refractory metal and is sufficient to cause diffusion of nickel and the refractory metal at the interface of the two metals, thereby resulting in metal-to-metal bonding. This mutual diffusion of metals, also referred to as interdiffusion, results in intermetallic bonding between nickel and the refractory metal. The adherence of the deposited nickel to the refractory metal substrate is thus improved because the intermetallic bonding is much stronger than the mechanical bonding between the two metals. After heating, the article may then be cooled to room temperature.

In some instances, it may be desirable to apply another layer of material, such as a metal, on the surface of the second layer of nickel. Various metals may be applied to the second layer of nickel. The surface of the second layer of nickel may be electrochemically etched by being made anodic in a nickel electroplate bath, such as a Woods bath, which typically comprises about 32 oz. per gallon $NiCl_2.6H_2O$ and 16 fluid oz. per gallon hydrochloric acid. After rinsing the etched surface, the layer of metal may be plated on the nickel surface by any of the electroplating processes described above. The current imparted to the article in the Woods bath is sufficient to result in a current density of about 25 amperes per square foot, and the bath may be at room temperature. The time for which the article remains immersed may range from about 30 seconds to about 60 seconds. Alternatively, the surface of the second layer of nickel may be etched in an acidic solution similar to that used prior to the deposition of the first layer of nickel, as described above. However, the electrochemical etch in the Woods bath is preferred. The thickness of this third layer of metal is not critical and depends on the contemplated end use of the article. The addition of this third layer of metal strengthens the article and further protects the underlying refractory metal substrate.

Alternatively, the third layer of material to be applied on the second layer of nickel may be a synthetic polymeric material, i.e. a plastic. Many polymers may be suitable, such as polyethylenes, polyesters, polycarbonates and polyphenylene oxides. The second layer of nickel need not be etched in this alternative embodiment. The synthetic polymer may be applied to the second layer of nickel by well-known coating methods, such as by dip coating. The thickness of the layer of polymeric material depends on the end use of the article.

The article produced by the improved method of the present invention is characterized by excellent adhesion between the nickel layers and the underlying refractory metal substrate. The method of the present invention also eliminates a heating step, since heating of the article is not required until after the full thickness of nickel has been applied, thereby greatly simplifying the process. The simplification of the process in turn results in shorter processing times and lower overall production costs.

The following specific examples describe the novel methods of the present invention. They are intended for illustrative purposes of specific embodiments only and should not be construed as a limitation upon the broadest aspects of the invention.

EXAMPLE 1

Various clean tantalum articles were abraded by blasting the surfaces with glass beads. The articles having abraded surfaces were then chemically cleaned by etching for about 5 minutes in a solution of 50% by weight hydrofluoric acid, 45% by weight water, and 5% by weight nitric acid. After the articles were rinsed, an electrical lead was attached to the articles. A first layer of nickel was then applied to the surface of the tantalum article by electroplating in a Watts bath containing nickel sulfate, nickel chloride and boric acid. The electroplating was carried out for about 4 minutes at a current sufficient to result in a current density of 35 amperes per square foot to form a strike plate having a thickness of about 0.1–0.2 mil. The article was then again rinsed. A second layer of nickel was applied to the first layer of nickel while the article was immersed in an Allied Kelite sulfamate nickel bath having a pH of 3.6–4.4 and comprising 43.6 oz./gal. of nickel sulfamate and about 4–6 oz./gal. of boric acid, along with 0.3–0.5 oz./gal of "Additive A". The electroplating was carried out at a current density of 35 amperes per square foot. The total thickness of the first and second layers of nickel was about 7 mils. After the second layer of nickel was applied, the article was rinsed and air-dried. The article was then heated in a vacuum at about 600° C. for about 60 minutes. Twelve articles were electroplated and heated according to the above process. The presence of adhesion is determined by bending the articles at an angle of 360° over a mandrel. A sharp knife is used to try to pry loose the plating metal at the broken edges. If the plating metal cannot be pried loose, the article has passed the adhesion test. All of the above articles passed this adhesion test.

EXAMPLE 2

Articles plated by a method outside the scope of the present invention and characteristic of prior art methods were prepared. Articles made of tantalum were first abraded as in Example 1. The articles were ultrasonically cleaned in an acidic solution prior to rinsing, as in Example 1. The articles were then immersed in an electroless nickel solution commercially referred to as CuTech-90 for about 5 minutes. The CuTech-90 solution comprises about 0.75 oz. nickel metal/gal. total solution, along with about 3.2–5.1 fluid oz. of Ni-90 reducer concentrate, and has a pH of 6–7. The temperature of the electroless bath was about 195° F., and the bath was vigorously agitated. The articles were then rinsed and immersed in a sulfamate nickel electroplating bath for about 5 hours to achieve a thickness of about 7 mils. After being rinsed and air-dried, the articles were heated at about 600° C. for about one hour. Twelve samples were prepared by the above process.

The samples were then visually examined, and the two samples checked were unacceptable because of blistering. It appeared that the nickel did not cover the tantalum substrate in the areas where the blisters occurred. The prior art process was thus found to be inferior to the method of the present invention.

EXAMPLE 3

Articles were plated by another method outside the scope of the present invention. The method was similar to that of Example 1, except that only one layer of nickel was applied, i.e. the strike-plating step was omitted from the process. In this method, the articles were abraded and then ultrasonically cleaned in an acidic solution as in Examples 1 and 2. The articles were then rinsed and immersed in a sulfamate nickel electroplating bath having a current density of 35 amperes per square foot. The thickness of the single nickel plate was about 7 mils after about 5 hours of immersion. The articles were then rinsed and air-dried prior to being heated for about 60 minutes at about 600° C. Although the articles did not blister, a microscopic examination of a metallurgical cross section of the samples indicated that intermetallic bonding between the nickel layers and the tantalum substrate had not occurred. Therefore, the adhesion of the nickel layer to the underlying tantalum substrate prepared by this prior art method was inferior to the adhesion exhibited by the articles in Example 1.

EXAMPLE 4

Cup-shaped articles were plated by the process of the present invention. The articles were abraded and then chemically cleaned by etching for 5 minutes in an ultrasonic bath containing the acidic solution described in Example 1. The articles were then rinsed in a spray rinse for about 90 seconds. An electrical lead was then attached to the articles, and a voltage of about 3 volts was applied prior to immersion of the articles in a Watts bath. The current density was adjusted to about 35 amperes per square foot. Mild agitation of the bath was maintained while the articles were immersed for about 5 minutes. This resulted in a layer of nickel having a thickness of about 0.1–0.2 mil on the tantalum surface. The articles were again rinsed for about 90 seconds and then immersed in a sulfamate nickel bath having a temperature of about 60° C. The current density was adjusted to 35 amperes per square foot, and the article was rotated to insure uniform coverage by the plating metal. After about 6 hours, the total thickness of nickel achieved was about 7 mils to about 9 mils. After being rinsed and air-dried, the article was heated in a vacuum at about 600° C. for about 60 minutes. Four articles were electroplated by this method, and the adhesion of the nickel to the substrate resulting from the vacuum heat treatment appeared to be excellent in each instance.

The method of the present invention may be used for the nickel plating of many refractory metal surfaces, such as insulation-backed heat shields, and will replace more costly methods which require a heat treatment before the full thickness of nickel is applied to those surfaces.

While the invention has been described with respect to preferred embodiments, it will be apparent that certain modifications and changes can be made without departing from the spirit and scope of the invention and, therefore, it is intended that the foregoing disclosure be limited only by the claims appended hereto.

What is claimed is:

1. An improved method of depositing nickel on a clean clear refractory metal surface to form a multilayer article, comprising:

(a) etching the surface;
(b) rinsing the etched surface;
(c) applying a first layer of nickel on the etched surface by electroplating means;
(d) again rinsing the surface;
(e) applying a second layer of nickel on the first layer of nickel by electroplating means; and
(f) heating the article once after plating has been completed in the absence of air for a period of time sufficient to cause intermetallic bonding between nickel and the refractory metal.

2. The method of claim 1 wherein the refractory metal is a metal selected from the group consisting of titanium, zirconium, hafnium, vanadium, niobium, tantalum, chromium, molybdenum, tungsten, and mixtures thereof.

3. The method of claim 1 further comprising abrading the surface prior to step (a).

4. The method of claim 1 wherein the surface is etched in step (a) in an acidic solution.

5. The method of claim 4 wherein the acidic solution comprises hydrofluoric acid and water.

6. The method of claim 5 wherein the solution additionally comprises nitric acid.

7. The method of claim 1 further comprising rinsing and drying the surface prior to step (f).

8. The method of claim 1 wherein the first layer of nickel is applied on the clean refractory metal surface by applying a voltage to the article and then immersing the article in an electroplating bath to impart an electric current to the article for a time period sufficient for the nickel to cover completely the surface of the refractory metal.

9. The method of claim 8 wherein the plating bath comprises nickel sulfate, nickel chloride and boric acid.

10. The method of claim 8 wherein the electric current results in a current density of about 25 amperes per square foot to about 45 amperes per square foot, and wherein the time period is from about 3 minutes to about 7 minutes.

11. The method of claim 10 wherein the temperature of the bath is about 45° C. to about 65° C.

12. The method of claim 1 wherein the second layer of nickel is applied on the first layer of nickel by applying a voltage to the article and then immersing the article in an electroplating bath to impart an electric current to the article for a time period sufficient to deposit nickel to a desired thickness.

13. The method of claim 12 wherein the electroplating bath is a sulfamate bath.

14. The method of claim 12 wherein the electroplating bath is a fluoborate bath.

15. The method of claim 12 wherein the electroplating bath is a chloride bath.

16. The method of claim 12 wherein the electric current results in a current density of about 20 amperes per square foot to about 60 amperes per square foot and wherein the time period is from about 4 hours to about 14 hours.

17. The method of claim 16 wherein the temperature of the bath is about 40° C. to about 60° C.

18. The method of claim 1 wherein the article is heated in a vacuum.

19. The method of claim 1 wherein the article is heated in an inert atmosphere.

20. The method of claim 19 wherein the inert atmosphere is argon.

21. The method of claim 19 wherein the inert atmosphere is helium.

22. The method of claim 1 wherein the article is heated at a temperature of about 500° C. to about 650° C.

23. The method of claim 22 wherein the article is heated for about 60 minutes to about 120 minutes.

24. The method of claim 23 wherein the article is heated in a vacuum.

25. The method of claim 23 wherein the article is heated in an inert atmosphere.

26. The method of claim 25 wherein the inert atmosphere is argon.

27. The method of claim 25 wherein the inert atmosphere is helium.

28. The method of claim 1 wherein the thickness of the first layer of nickel is about 0.1 mil to about 0.2 mil.

29. The method of claim 1 further comprising applying a third layer of material on the second layer of nickel by electroplating means subsequent to step (f).

30. The method of claim 29 wherein the third layer of material is a metal.

31. The method of claim 29 wherein the third layer of material is a synthetic polymer.

* * * * *